US009565939B2

(12) United States Patent
Brock et al.

(10) Patent No.: US 9,565,939 B2
(45) Date of Patent: Feb. 14, 2017

(54) UNDERMOUNT SLIDE ASSEMBLY

(71) Applicant: Jonathan Manufacturing Corporation, Irvine, CA (US)

(72) Inventors: Patty J. Brock, Irvine, CA (US); Gaetano G. Galletti, Costa Mesa, CA (US)

(73) Assignee: Jonathan Manufacturing Corporation, Irvine, CA (US)

( * ) Notice: Subject to any disclaimer, the term of this patent is extended or adjusted under 35 U.S.C. 154(b) by 0 days.

(21) Appl. No.: 15/058,021

(22) Filed: Mar. 1, 2016

(65) Prior Publication Data

US 2016/0249738 A1 Sep. 1, 2016

Related U.S. Application Data

(63) Continuation of application No. 14/481,759, filed on Sep. 9, 2014, now abandoned.

(60) Provisional application No. 61/876,147, filed on Sep. 10, 2013.

(51) Int. Cl.

| | |
|---|---|
| ***A47B 88/00*** | (2006.01) |
| ***A47B 88/10*** | (2006.01) |
| ***A47B 88/14*** | (2006.01) |
| ***A47B 88/04*** | (2006.01) |

(52) U.S. Cl.

CPC ..... *A47B 88/10* (2013.01); *A47B 88/0466* (2013.01); *A47B 88/14* (2013.01); *A47B 2210/0016* (2013.01); *A47B 2210/0032* (2013.01); *A47B 2210/0056* (2013.01); *A47B 2210/0072* (2013.01)

(58) Field of Classification Search

CPC ..... A47B 88/10; A47B 88/14; A47B 88/0418; A47B 2210/0056; A47B 2210/0032

USPC ..... 312/334.6, 334.27, 334.29, 334.31,312/334.32, 334.33, 334.34, 334.3, 8, 245; 384/18, 21, 22, 23

See application file for complete search history.

(56) References Cited

U.S. PATENT DOCUMENTS

| | | | |
|---|---|---|---|
| 263,055 | A | 8/1882 | Moore |
| 608,130 | A | 7/1898 | Kandle |
| 2,926,048 | A | 2/1960 | Remke |

(Continued)

FOREIGN PATENT DOCUMENTS

| | | | |
|---|---|---|---|
| GB | 2079145 | A | 1/1982 |

OTHER PUBLICATIONS

Johnathan Engineering, Aluminum Slides, Series 300/SB/T Undermount; archived Sep. 14, 2011; 2 pages; printed from website on Jul. 17, 2015; https://tweb.archive.org/web/20110914070627; http://jonathanengr.com/series-300sbt-undermount-c-1247.html.

*Primary Examiner* — Janet M Wilkens

(74) *Attorney, Agent, or Firm* — Knobbe, Martens, Olson & Bear LLP

(57) ABSTRACT

An undermount slide assembly includes an outer slide segment, an intermediate slide segment and an inner slide segment. The outer slide segment has a web, a first flange and a second flange. The web defines an upper surface that is mountable to a first object. The intermediate slide segment has a web, a first flange and a second flange. The web is received within a space defined between the first and second flanges of the outer slide segment. At least portions of the first and second flanges of the intermediate slide segment extend below the first and second flanges of the outer slide segment. The web and the first and second flanges of the intermediate slide segment define a space therebetween. An inner slide segment is received within the space defined between the web and the first and second flanges of the intermediate slide segment.

8 Claims, 5 Drawing Sheets

(56) References Cited

U.S. PATENT DOCUMENTS

| | | | |
|---|---|---|---|
| 3,258,299 | A | 6/1966 | Meyer |
| 3,337,172 | A | 8/1967 | Jackson |
| 3,371,968 | A | 3/1968 | Albert |
| 4,470,642 | A | 9/1984 | Gasperin |
| 4,653,821 | A | 3/1987 | Faust |
| 5,417,489 | A | 5/1995 | Compagnucci |
| 5,769,518 | A | 6/1998 | Grabher |
| 7,866,772 | B1 | 1/2011 | Chen |
| 8,474,926 | B2 | 7/2013 | Prentner |
| 8,678,529 | B2 | 3/2014 | Li |
| 2003/0197452 | A1 | 10/2003 | Kung |
| 2004/0130248 | A1 | 7/2004 | Chi |
| 2005/0174021 | A1 | 8/2005 | Blum et al. |
| 2009/0074334 | A1 | 3/2009 | Juan |
| 2010/0026154 | A1 | 2/2010 | Johansson |

UNDERMOUNT SLIDE ASSEMBLY

RELATED APPLICATIONS

Related applications are listed in an Application Data Sheet (ADS) filed with this application. The entirety of each application listed in the ADS is hereby incorporated by reference herein.

BACKGROUND OF THE INVENTION

Field of the Invention

The present invention relates to slide assemblies, in general, and to slide assemblies suitable for use in an undermount application, in particular.

Description of the Related Art

Undermount slide assemblies are used to movably support one object (e.g., a drawer) relative to another object (e.g., a cabinet or enclosure). Typically, an undermount slide assembly is located underneath the movable object, in contrast to other slide assemblies, which are typically located on the side of the movable object. Because it is located underneath the movable objection, the slide assembly occupies space that otherwise could be occupied by the movable object.

SUMMARY OF THE INVENTION

Accordingly, a need exists for new undermount slide assemblies that accomplish to at least some extent one or more of the following: reduce the overall cross-sectional dimensions (especially height), increase load capacity and improve performance (e.g., ease of movement, reliability or longevity). The systems, methods and devices described herein have innovative aspects, no single one of which is indispensable or solely responsible for their desirable attributes. Without limiting the scope of the claims, some of the advantageous features will now be summarized.

An embodiment involves an undermount slide assembly including an outer slide segment having a web, a first flange and a second flange, wherein the web defines an upper surface that is mountable to a first object. An intermediate slide segment has a web, a first flange and a second flange, wherein the web is received within a space defined between the first and second flanges of the outer slide segment, and wherein at least portions of the first and second flanges of the intermediate slide segment extend below the first and second flanges of the outer slide segment, and wherein the web and the first and second flanges of the intermediate slide segment define a space therebetween. An inner slide segment is received within the space defined between the web and the first and second flanges of the intermediate slide segment.

In some configurations, the inner slide segment comprises a slide engagement portion that is generally or substantially cylindrical in shape. In some configurations, the space defined by the web and the first and second flanges of the intermediate slide segment is partially cylindrical in shape.

In some configurations, sets of bearings are provided between one or more of the outer, intermediate and inner slide segments. The bearings can comprise lateral bearings are provided between the outer and intermediate slide segments. In some configurations, only lateral bearings are provided between the outer and intermediate slide segments. In some configurations, an upper set of bearings is provided between the intermediate slide segment and the inner slide segment. In some configurations, additionally lateral bearings are provided between the intermediate slide segment and the inner slide segment.

In some configurations, the inner slide segment comprises a mounting portion. The mounting portion can be L-shaped in cross-section. The inner slide segment can be a two-piece construction in which a first member that supports the first object is removable from a second member that is directly engaged with the intermediate slide segment. The undermount slide assembly can include a lock arrangement that secures the first member relative to the second member and allows selective removal of the first member from the second member.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Preferred embodiments of the undermount slide assemblies preferably include three slide segments telescopically engaged with one another to move between a closed position and an open position. The segments may be any suitable shape to permit telescopic engagement between the segments. However, certain preferred cross-sectional shapes are illustrated and/or described herein that are believed to provide advantages over other possible shapes. Typically, one or more slide assemblies permit one object to be supported and moved relative to another object. One object is often stationary, such as an enclosure or cabinet, and the other object, such as a drawer, is movable between an open and closed position relative to the stationary object. Often, a slide assembly is provided on each side of the supported object.

For convenience, the slide assembly is referred to as having an outer or outboard side and an inner or inboard side. The outer or outboard side typically is positioned closer to the stationary object in a lateral direction relative to the inner or inboard side. Also, the slide assembly is referred to as having a forward end and a rearward end. The slide assembly opens from the forward end and moves away from the rearward end. The slide assembly is also referred to as having an upper portion and a lower portion. These, and other relative terms (top, bottom, above, below, etc.) are used for convenience and with respect to the particular orientation shown in the referenced figures and are not intended to be limiting. Thus, the slide assemblies can also be used in other orientations or applications, or adapted for use in orientations or applications other than those illustrated.

The preferred embodiments disclosed herein are well-suited for use in movably supporting drawers relative to an enclosure or cabinet, preferably in an undermount orientation. For example, and without limitation, the illustrated slide assembly is well-suited for use in commercial, business or other airplane applications, or other similar applications. In addition, the slide assemblies are capable of supporting the loads expected by the intended application, and often additional loading, while still maintaining smooth extension and retraction of the slide assembly. Preferably, the slide assemblies are lightweight for the given load capacity and, thus, can be constructed from aluminum, for example, instead of steel. Holes may be provided throughout any portion or all of a length of the individual slide segments of the slide assemblies to further reduce weight. The slide assemblies can be of any desired length and have any desired travel distance.

Figure 1:
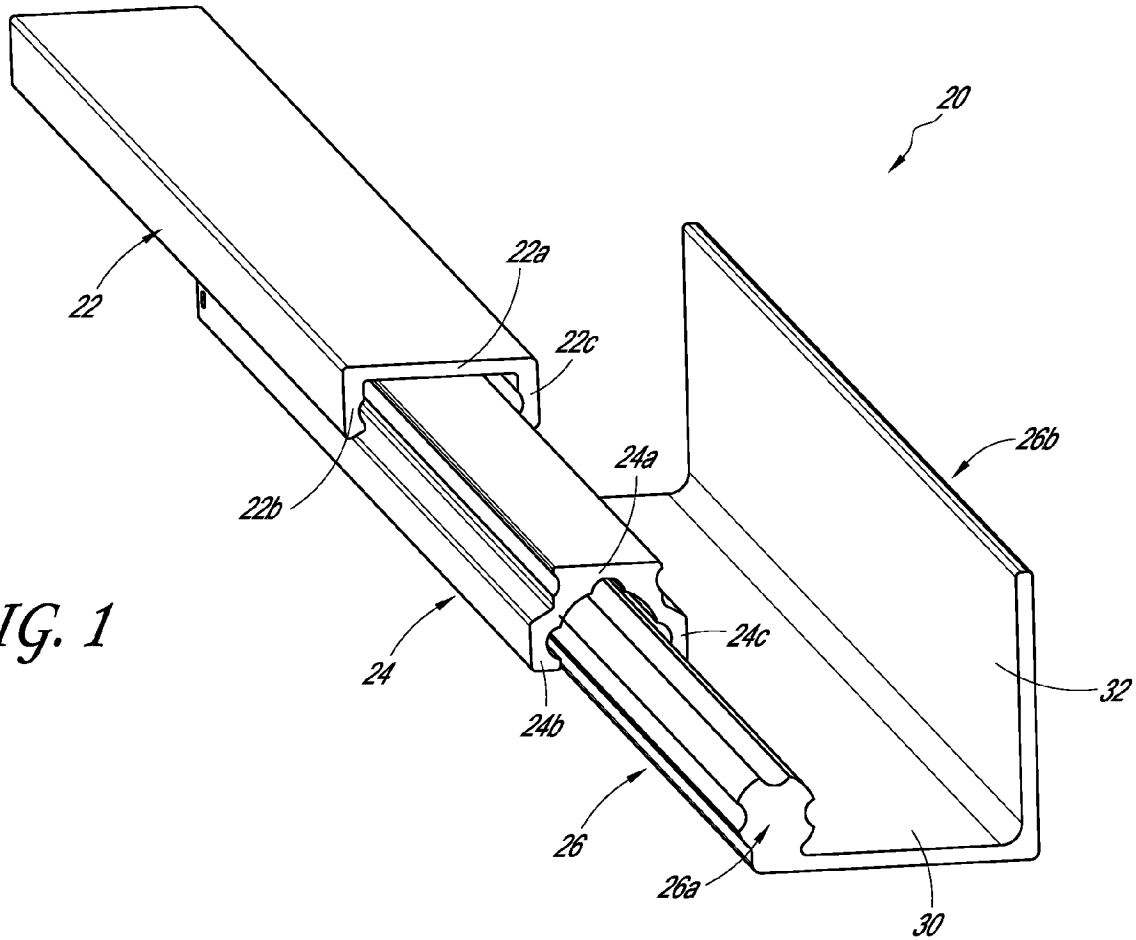
FIG. 1 is a rear perspective view of an undermount slide assembly having certain features, aspects and advantages in accordance with the present invention.
Figure 2:
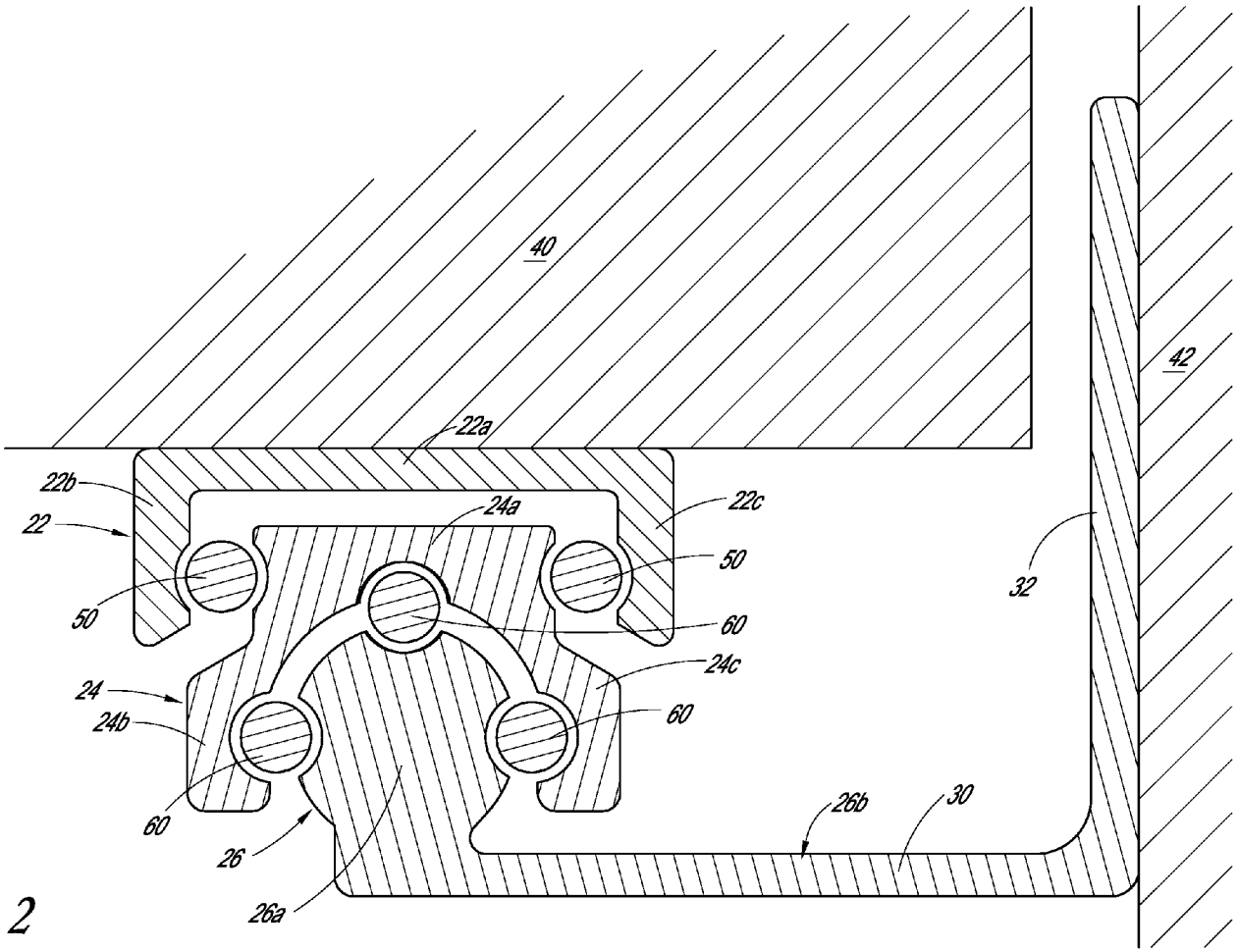
FIG. 2 is a front view of the undermount slide assembly of FIG. 1.

FIGS. 1 and 2 illustrate an undermount slide assembly 20 having certain features, aspects and advantages of the preferred embodiments. FIG. 1 is a rear view of the slide assembly 20 in an open position. FIG. 2 is a front view of the slide assembly 20. In the illustrated arrangement, the slide assembly 20 includes three slide segments: a first or inner slide segment 22, a second or intermediate slide segment 24 and a third or outer slide segment 26 telescopically engaged with one another and movable between a closed position and an open position. However, in other arrangements, the slide assembly 20 may include only two segments, or more than three segments. In this context, the terms outer, intermediate and inner refer to an orientation of the slide segments relative to one another in accordance with the correspondence with the function of slide segments of a side mount slide assembly. In other words, the inner slide segment 22 is positioned to be connected to the movable object or drawer. The inner slide segment 22 is actually positioned outwardly of at least portions of the intermediate slide segment 24 and/or outer slide segment 26. Similarly, the intermediate slide segment 24 surrounds or is positioned outwardly of at least a portion of the outer slide segment 26, which is coupled to the stationary object or cabinet. However, other arrangements are also possible. Therefore, the terminology is used herein as a convenience and is not intended to be limiting unless indicated otherwise.

As described in greater detail hereinafter, the slide assembly 20 can include one or more locking mechanisms that permit the slide assembly 20 to be selectively locked or retained (e.g., a detent arrangement) in one or more of a closed position, an open position, and a partially open or closed position, among others. In addition, the slide assembly 20 preferably includes bearings (ball bearings, rollers or other suitable arrangements) interposed between the slide segments 22, 24, 26 to facilitate smooth relative movement therebetween. However, in other arrangements, the segments 22, 24, 26 can slide directly on one another without any bearing arrangement.

Preferably, one or more of the slide segments 22, 24, 26 are formed by an extrusion or other similar or suitable process into a final or near-final cross-sectional shape. Preferably, one or more of the slide segments 22, 24, 26 are constructed from an aluminum material. However, other suitable materials (e.g., metals or plastics) and/or suitable manufacturing methods can be used to suit the desired application.

Preferably, the inner slide segment 22 includes a web or horizontal wall portion 22*a*, a first flange or inner wall portion 22*b* and a second flange or outer wall portion 22*c*. The inner wall portion 22*b* and outer wall portion 22*c* extend in the same direction from opposite edges of the horizontal wall portion 22*a*. In the illustrated arrangement, the inner wall portion 22*b* and outer wall portion 22*c* extend downwardly from the horizontal wall portion 22*a*. Preferably, the web or horizontal wall portion 22*a* is generally or substantially planar or, in cross-section, generally linear in shape having a generally or substantially planar (or linear) upper surface and a generally or substantially planar (or linear) lower surface.

The illustrated intermediate slide segment 24 is formed with a cross-sectional shape generally similar to that described above with respect to the inner slide segment 22. Thus, the intermediate slide segment 24 preferably includes a web or horizontal wall portion 24*a*, a first flange or inner wall portion 24*b* and a second flange or outer wall portion 24*c*. In the illustrated arrangement, transitions between the web 24*a* and first and second flanges 24*b*, 24*c* are less obvious or less pronounced than those of the inner slide segment 22. Preferably, the horizontal wall portion 24*a* has a generally or substantially planar (or linear in cross-section) upper surface facing the web 22*a* of the inner slide segment 22 and a generally or substantially semi-cylindrical (or semi-circular in cross-section) lower surface facing away from the inner slide segment 22. The lower surface could define a portion of a cylinder other than exactly one-half or semi-cylindrical. For example, the lower surface could be less than or greater than one-half of a cylinder. Also, the term cylinder is used in a broad sense herein, covering an extrusion of a closed loop of any shape—not necessarily circular (e.g., rectangular, square, oval or irregular).

In addition, the intermediate slide segment 24 preferably has a narrower upper portion, at least a portion of which is received within the inner slide segment 22 (within a space defined between the flanges 22*b*, 22*c*), and a wider lower portion, at least a portion of or, preferably, an entirety of is located below the flanges 22*c*, 22*c* of the inner slide segment 22 (outside of or below the space defined between the flanges 22*b*, 22*c*). Preferably, a width of the outer surfaces of the flanges 24*b*, 24*c* (a maximum outer dimension of the illustrated intermediate slide segment 24) of the intermediate slide segment 24 is no wider than a width of the outer surfaces of the flanges 22*b*, 22*c* (a maximum outer dimension of the illustrated inner slide segment 22) of the inner slide segment 22. Preferably, the width of the intermediate slide segment 24 is about the same as a width of the space between the flanges 22*b*, 22*c* or slightly greater than that width. Thus, preferably, the width of the intermediate slide segment 24 is equal to or somewhere between the width of the space between the flanges 22*b*, 22*c* and the width of the inner slide segment 22.

The illustrated outer slide segment 26 preferably has a slide engagement portion 26*a* and a mounting portion 26*b*. The slide engagement portion 26*a* engages the other segments 22, 24 of the slide assembly 20 and the mounting portion 26*b* extends from the slide engagement portion 26*a* and is configured to permit the outer slide segment 26 to be attached or mounted to an object (such as the stationary object in the illustrated arrangement). The slide engagement portion 26*a* and the mounting portion 26*b* can be of a unitary construction (i.e., formed as a single piece) or can be multiple pieces coupled together. For example, the slide engagement portion 26*a* can be a first piece (e.g., an extruded piece) and the mounting portion 26*b* can be a second piece (e.g., an extruded or bent piece).

Preferably, the slide engagement portion 26*a* of the outer slide segment 26 is generally or substantially cylindrical in shape (or circular in cross-sectional shape). The slide engagement portion 26*a* is received within the intermediate slide segment 24 (within the spaced defined by the web 24*a* and flanges 24*b*, 24*c*). The mounting portion 26*b* can have either or both of a first or horizontal portion 30 and a second or vertical portion 32. Thus, in some arrangements, the mounting portion 26*b* is generally or substantially L-shaped in cross-section. In the illustrated arrangement, the horizontal portion 30 spaces the vertical portion 32 in a lateral direction from the slide engagement portion 26*a*. Preferably, the vertical portion 32 is positioned outwardly from the slide engagement portion 26*a* a distance sufficient to allow the inner slide segment 22 to be secured to preferably a bottom surface of the movable object 40 at a location spaced inwardly from an outer edge thereof. The vertical portion 32 can be secured to a vertical surface of the stationary object 42. Alternatively or in addition, the horizontal portion 30 could be secured to a horizontal surface of the stationary object 42. If desired, the vertical portion 32 could be omitted. In addition, other suitable constructions for the mounting portion 26*b* can be employed to suit the desired application.

Preferably, the intermediate slide segment 24 is supported for movement relative to the inner slide segment 22 by a plurality of bearings and, in particular, ball bearings 50. In the illustrated arrangement, a first set of ball bearings are provided between the respective inner flanges 22*b*, 24*b* of the inner and intermediate slide segments 22, 24 and a second set of ball bearings are provided between the respective outer flanges 22*c*, 24*c* of the inner and intermediate slide segments 22, 24. Thus, the ball bearings 50 are provided on each lateral side of the slide segments 22, 24. In the illustrated arrangement, the lateral side bearings 50 are the only bearings between the inner slide segment 22 and the intermediate slide segment 24. The slide segments 22, 24 preferably surround enough of the bearings 50 (have sufficient ball wrap) to permit such an arrangement. However, in other arrangements, alternative or additional bearing arrangements can be provided. For example, one or more bearing arrangements could be provided between the respective webs 22*a*, 24*a* of the inner and intermediate slide segments 22, 24.

The individual ball bearings 50 preferably are constructed from a polymer material for light weight and, if desired, can be spaced from one another by separate bearing carriers between the respective bearing surfaces of the outer slide segment 22 and intermediate slide segment 24. However, in other preferred embodiments, the carriers may be interconnected by a horizontal wall portion to define a single carrier that carries the inner and outer ball bearings 50. Forward and rearward bearing stops can be provided in the path of the ball bearings 50 to retain the bearings 50 from becoming dislodged from the slide assembly 20.

Preferably, the outer slide segment 26 is supported for movement relative to the intermediate slide segment 24 by a plurality of bearings and, in particular, ball bearings 60. In the illustrated arrangement, three sets of bearings are provided: an inner lateral set of bearings, an outer lateral set of bearings and an upper set of bearings. The upper set of bearings can be centrally located on the outer slide segment 26 and/or on the slide assembly 20. That is, preferably, the slide assembly 20 (with the exception of the mounting portion 32) can be generally or substantially symmetrical about a central, vertical axis. The upper set of bearings can be located partially or completely within the space defined by the inner slide segment 22. That is, the upper set of bearings can be partially or completely above a lower edge of the flanges 22*b*, 22*c*. The upper set of bearings can be approximately even with or slightly below the lateral bearings 50 between the inner slide segment 22 and the intermediate slide segment 24. The illustrated arrangement provides the slide assembly 20 with a relatively small overall height, while also providing an advantageous load-carrying capacity.

The individual ball bearings 60 can be constructed from a polymer material to be light weight and, if desired, can be separated from one another by a single carrier that carries the inner and outer ball bearings 60. However, separate bearing carriers respectively carrying the inner and outer bearings could also be used. Forward and rearward bearing stops can be provided in the path of the ball bearings 60 to prevent the bearings 60 from being dislodged from the slide assembly 20. Although loose ball bearings 50 and 60 are illustrated, other suitable mechanisms may be used to allow smooth movement between the individual segments 22, 24, 26, including solid bearing surfaces, for example.

The slide assembly 20 may include multiple locks, which operate to secure segments in desirable positions relative to one another and release the segments at a desirable time during cycling of the slide assembly 20. For example, a first lock arrangement could couple the inner slide segment 22 for movement with the intermediate slide segment 24 during the initial opening of the slide assembly 20 from the closed position and then decouple the inner slide segment 22 from the intermediate slide segment 24 to allow the inner slide segment 22 to continue moving toward an open position independently of the intermediate slide segment 24. Such a first lock arrangement could also secure the intermediate segment 24 in an open position relative to the outer segment 26. Moreover, the first lock arrangement could be released by the inner slide segment 22 during closing of the slide assembly 20.

The slide assembly 20 could also or alternatively include a second lock arrangement that operates to selectively secure the inner slide segment 22 in an open position relative to the intermediate slide segment 24 and prevents movement in at least one direction from the open position. Such a second lock arrangement could inhibit movement in both directions from the open position. In other words, the second lock arrangement could prevent removal of the inner slide segment 22 from the intermediate slide segment 24. In addition, closing of the inner slide segment 22 could be prevented until the second lock arrangement is released.

The slide assembly 20 could also employ other locks to accomplish other functions. For example, a third lock arrangement could be operable to selectively secure the inner slide segment 22 in an intermediate position, between an open position and a closed position, relative to the intermediate slide segment 24. The slide assembly 20 could also include a fourth lock arrangement or a "lock closed" arrangement. The fourth lock could be configured to selectively secure the slide assembly 20 in a closed position, in which the intermediate slide segment 24 is retracted relative to the outer slide segment 26, and the inner slide segment 22 is retracted relative to the intermediate slide segment 24. Preferably, the third and fourth locks are of any suitable construction from a structural and functional standpoint.

Although multiple lock arrangements are discussed herein and referred to as first, second, third and fourth locks, it is not required nor implied that all four lock arrangements are necessarily present in any particular embodiment. Rather, some or all of the lock arrangements may be used depending on the particular application and the desired operational sequence of the slide assembly. Moreover, additional lock arrangements may also be provided.

If desired, the slide assemblies 20 can include an automatic closure arrangement with or without a dampening arrangement. For example, one or more biasing elements (e.g., springs or constant force springs) could be utilized to retract the intermediate slide segment 24 and/or outer slide segment 22 relative to the outer slide segment 26. A dampener can dampen at least a portion of the travel of the slide assembly 10, such as a final portion of the closure.

Figure 3:
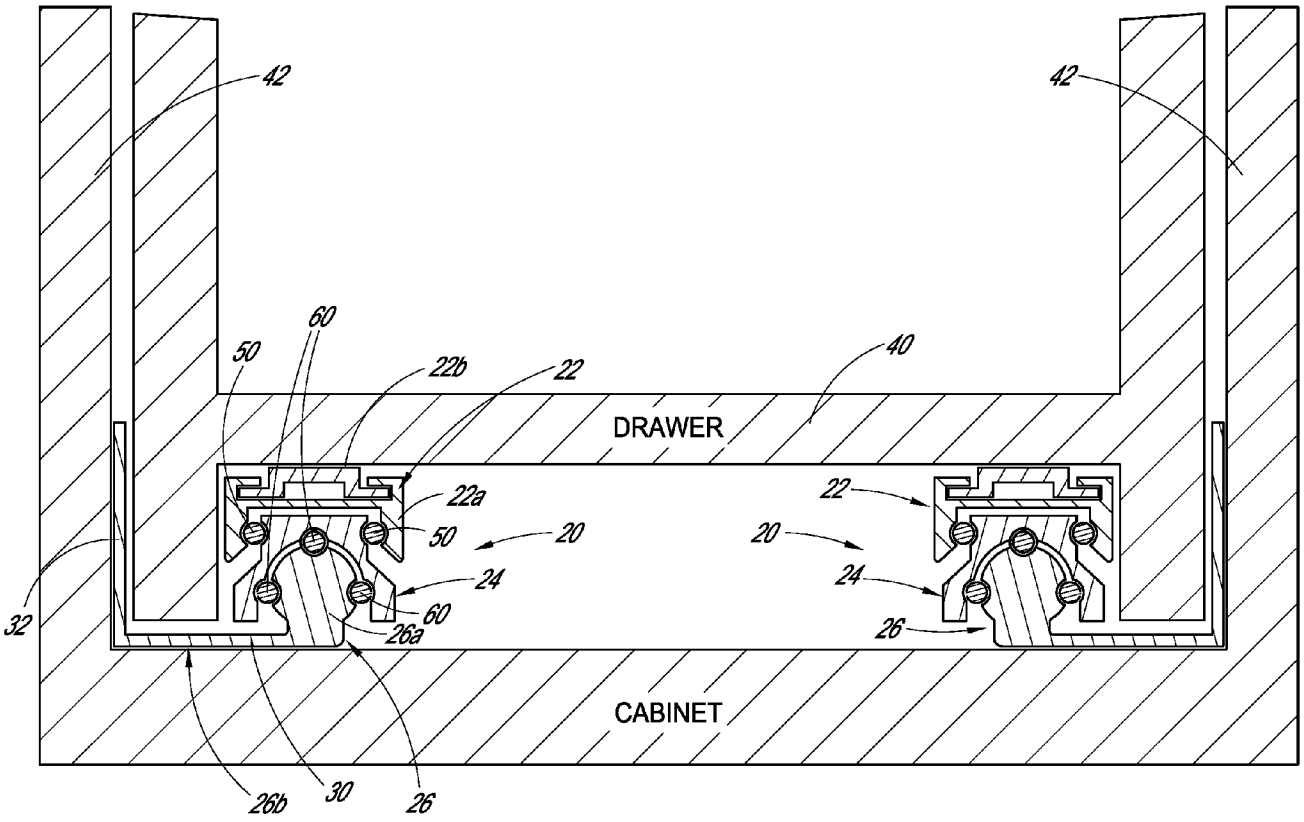
FIG. 3 is a front view of a pair of undermount slide assemblies supporting a drawer relative to a cabinet. The front of the drawer is removed to show underlying structure. The undermount slide assemblies include a multi-piece inner slide segment, which facilitates quick disassembly and removal of the drawer from the cabinet.
Figure 4:
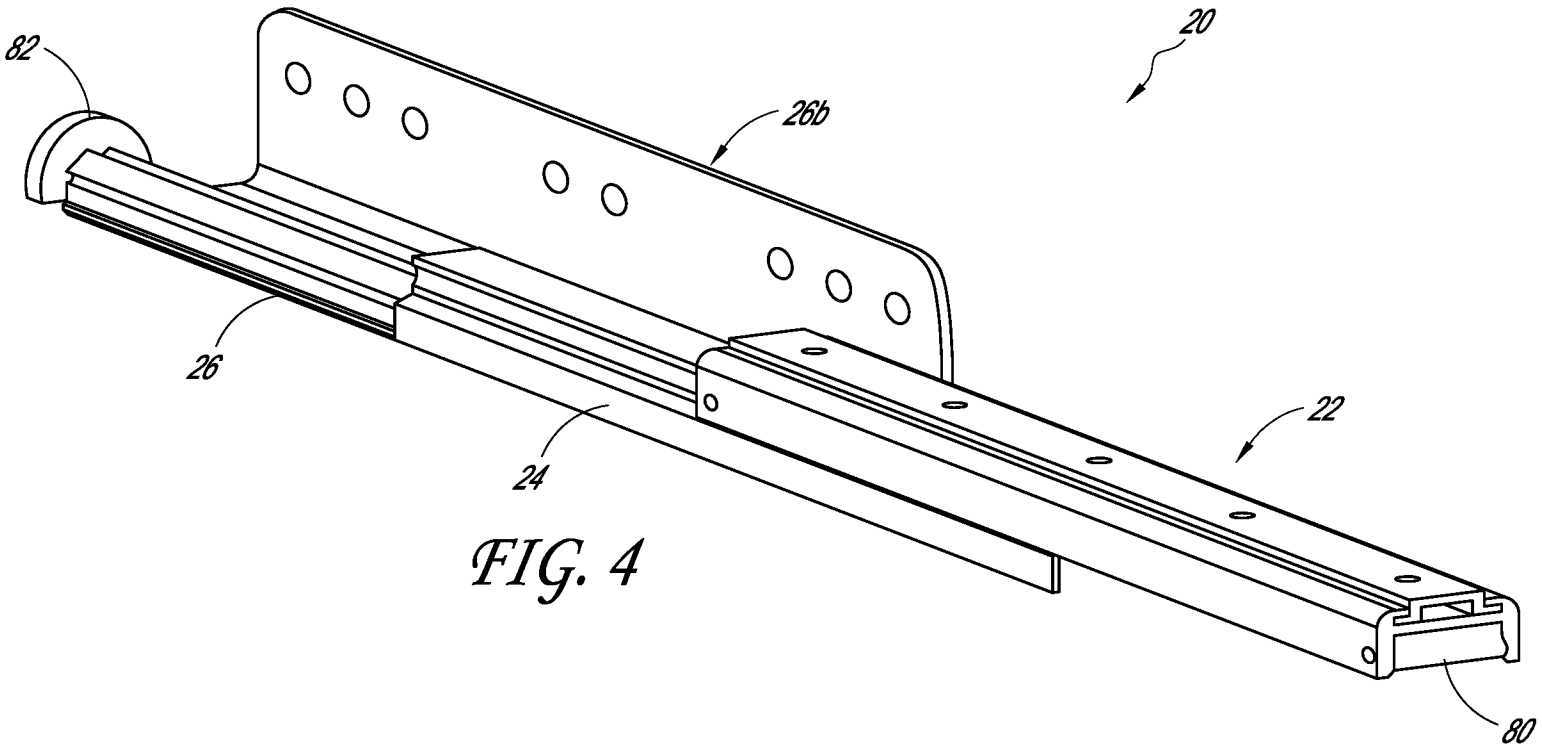
FIG. 4 is a perspective view of a slide assembly of FIG. 3 separate from the drawer and cabinet.
Figure 5:
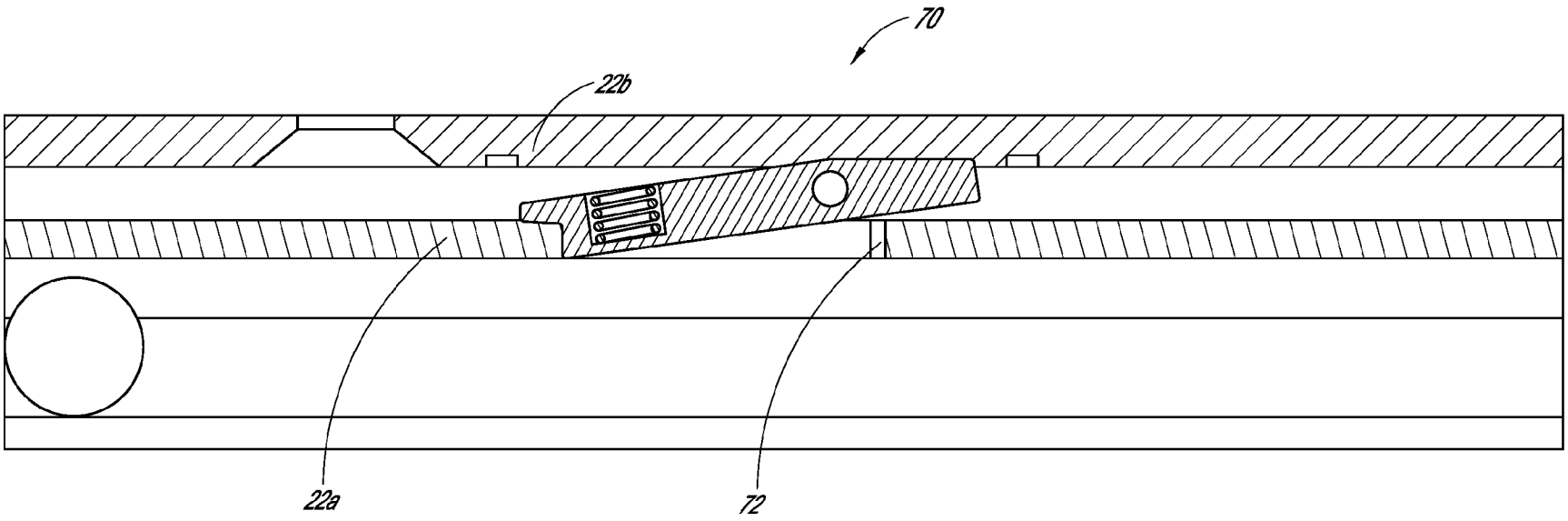
FIG. 5 is a longitudinal cross-sectional view of an inner slide segment illustrating a retention arrangement for retaining a first member of the inner slide segment relative to a second member of the inner slide segment and allowing selective removal of the first member from the second member.

FIGS. 3-5 illustrate a modification of the slide assembly 20, in which the inner slide segment 22 is of a multi-piece construction, such as a two-piece component, for example. The illustrated inner slide segment 22 has a first member 22*a* that defines the bearing surfaces and a second member 22*b* that is slidably-received within the first member 22*a*. Preferably, the first member 22*a* is an extruded aluminum member having a web and first and second flanges. The upper portions of the flanges of the first member 22*a* can have return portions at the outer or free ends of the flanges such that the upper portion of the first member 22*a* defines a C-shaped cross-sectional profile. A portion of the second member 22*b* can be received and vertically retained within the inner space defined by the C-shaped upper portion of the first member 22*a*. The second member 22*b* can be generally T-shaped in cross-section and can be a bent member, such as a bent piece of steel sheet metal, or can be an extruded member, such as extruded aluminum. The second member 22*b* preferably has one portion received within the inner space of the C-shaped portion of the first member 22*a* and the center portion of the second member 22*b* passing between the return portions of the C-shaped portion of the first member 22*a*.

The drawer (or other supported object) can be secured to the second member 22*b* and, thus, can be easily and quickly removed from the remainder of the slide assembly 20 by removing the second member 22*b* (and object) from the first member 22*a*. A lock arrangement or latch 70 can be carried by one of the first and second members 22*a*, 22*b* to engage an engagement or stop surface of the other of the first and second members 22*a*, 22*b*. In the illustrated arrangement, the latch 70 is carried by the second member 22*b* and engages a stop surface defined by an opening 72 of the first member 22*a* to inhibit unintentional or undesired removal of the second member 22*b* from the first member 22*a*. The latch 70 can be actuated (e.g., pressed upwardly) to disengage the latch 70 from the stop surface of the opening 72 and permit removal of the second member 22*b*. The first member 22*a* can include a stop (such as at a rearward end thereof) to define a fully inserted position of the second member 22*b*. The latch 70 can be of any suitable arrangement, such as a resilient arm, for example. However, in the illustrated arrangement, the latch 70 includes a pivotally-supported latch member that is biased toward a locked position by a biasing element, such as a spring.

With reference to FIG. 4, the slide assembly 20 can include one or more bumpers or soft stop arrangements. The bumpers can include a front bumper 80 and a rear bumper 82 that are constructed from a relatively soft material (e.g., elastomeric material) to soften and/or reduce the noise of the closure of the slide assembly 20. The front bumper 80 is a bar-shaped member that extends between the flanges at a forward end of the first member 22*a* of the inner slide segment 22 and is positioned to contact the intermediate slide segment 24 in the closed position of the slide assembly 20. The rear bumper 82 is supported on a rearward end of the outer slide segment 26 and extends upwardly to contact a rearward end of the intermediate slide segment 24 in the closed position of the slide assembly 20.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. Corresponding features can be interchanged between the embodiments. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. An undermount slide assembly, comprising:

an inner slide segment having a web, a first flange and a second flange, wherein the web defines an upper surface that is mountable to a first object;

an intermediate slide segment having a web, a first flange and a second flange, wherein the web is received within a space defined between the first and second flanges of the inner slide segment, wherein at least portions of the first and second flanges of the intermediate slide segment extend below the first and second flanges of the inner slide segment, wherein the web and the first and second flanges of the intermediate slide segment define a space therebetween;

an outer slide segment received within the space defined between the web and the first and second flanges of the intermediate slide segment;

a first set of bearings and a second set of bearings laterally-spaced and aligned with one another between the inner and intermediate slide segments;

wherein the first and second sets of bearings are spaced outwardly of at least a portion of at least one set of bearings between the intermediate and outer slide segments, wherein the outer slide segment comprises a slide engagement portion that is generally or substantially cylindrical in shape, and wherein the space defined by the web and the first and second flanges of the intermediate slide segment is partially cylindrical in shape.

2. The undermount slide assembly of claim 1, wherein the outer slide segment comprises a mounting portion.

3. The undermount slide assembly of claim 2, wherein the mounting portion is L-shaped in cross-section.

4. The undermount slide assembly of claim 1, wherein the first and second sets of bearings are the only bearings between the inner and intermediate slide segments.

5. An undermount slide assembly, comprising:

an inner slide segment having a web, a first flange and a second flange, wherein the web defines an upper surface that is mountable to a first object;

an intermediate slide segment having a web, a first flange and a second flange, wherein the web is received within a space defined between the first and second flanges of the inner slide segment, wherein at least portions of the first and second flanges of the intermediate slide segment extend below the first and second flanges of the inner slide segment, wherein the web and the first and second flanges of the intermediate slide segment define a space therebetween;

an outer slide segment received within the space defined between the web and the first and second flanges of the intermediate slide segment;

a first set of bearings and a second set of bearings laterally-spaced and aligned with one another between the inner and intermediate slide segments, wherein the first and second sets of bearings are spaced outwardly of at least a portion of at least one set of bearings between the intermediate and outer slide segments, wherein the inner slide segment is a two-piece construction in which a first member that supports the first object is removable from a second member that is directly engaged with the intermediate slide segment.

6. The undermount slide assembly of claim 5, further comprising a lock arrangement that secures the first member relative to the second member and allows selective removal of the first member from the second member.

7. An undermount slide assembly, comprising:

an inner slide segment having a web, a first flange and a second flange, wherein the web defines an upper surface that is mountable to a first object;

an intermediate slide segment having a web, a first flange and a second flange, wherein the web is received within a space defined between the first and second flanges of the inner slide segment, wherein at least portions of the first and second flanges of the intermediate slide segment extend below the first and second flanges of the inner slide segment, wherein the web and the first and second flanges of the intermediate slide segment define a space therebetween;

an outer slide segment received within the space defined between the web and the first and second flanges of the intermediate slide segment;

a first set of bearings and a second set of bearings laterally-spaced and aligned with one another between the inner and intermediate slide segments, wherein the first and second sets of bearings are spaced outwardly of at least a portion of at least one set of bearings between the intermediate and outer slide segments, wherein the first and second sets of bearings are the only bearings between the inner and intermediate slide segments, wherein the at least one set of bearings between the intermediate and outer slide segments comprises a third set of bearings, a fourth set of bearings and a fifth set of bearings, the third and fourth sets of bearings being laterally-spaced and aligned with one another, the fifth set of bearings being centrally-located in a lateral direction within the outer slide segment.

8. The undermount slide assembly of claim 7, wherein the fifth set of bearings is at least partially aligned in a vertical direction with the first and second sets of bearings.

* * * * *